US012767309B2

(12) United States Patent
Podell

(10) Patent No.: US 12,767,309 B2
(45) Date of Patent: Oct. 20, 2026

(54) MARINE DRIVES AND ARRANGEMENTS FOR COOLING ELECTRICAL COMPONENTS OF MARINE DRIVES

(71) Applicant: Brunswick Corporation, Mettawa, IL (US)

(72) Inventor: Robert A. Podell, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 349 days.

(21) Appl. No.: 18/406,863

(22) Filed: Jan. 8, 2024

(65) Prior Publication Data

US 2024/0270365 A1 Aug. 15, 2024

Related U.S. Application Data

(60) Provisional application No. 63/445,916, filed on Feb. 15, 2023.

(51) Int. Cl.

| | |
|---|---|
| ***B63H 20/32*** | (2006.01) |
| ***B63H 20/12*** | (2006.01) |
| ***B63H 21/17*** | (2006.01) |

(52) U.S. Cl.

CPC ..... *B63H 21/17* (2013.01); *B63H 20/12* (2013.01); *B63H 20/32* (2013.01)

(58) Field of Classification Search

CPC ..... B63H 20/12; B63H 20/32; B63H 21/17
See application file for complete search history.

(56) References Cited

U.S. PATENT DOCUMENTS

| | | | | |
|---|---|---|---|---|
| 9,701,383 | B1 | 7/2017 | Stuber et al. | |
| 9,963,213 | B1 | 5/2018 | Jaszewski et al. | |
| 10,975,762 | B1 * | 4/2021 | Langenfeld | F02M 31/20 |
| 2011/0244738 | A1 | 10/2011 | Daikoku | |
| 2019/0148700 | A1 | 5/2019 | Milroy et al. | |
| 2022/0194525 | A1 * | 6/2022 | Missler | B63H 21/22 |
| 2023/0234688 | A1 | 7/2023 | Jaszewski et al. | |
| 2023/0257094 | A1 | 8/2023 | Jaszewski et al. | |

FOREIGN PATENT DOCUMENTS

| | | | | |
|---|---|---|---|---|
| AU | 2020231602 | A1 * | 8/2021 | F02M 35/10222 |
| DE | 202016101681 | | 4/2016 | |
| JP | 2005162054 | | 6/2005 | |

OTHER PUBLICATIONS

Extended European Search Report for Corresponding EP Application No. 24 156910.2, dated Jul. 12, 2024.

* cited by examiner

*Primary Examiner* — Benjamin F Fiorello
(74) *Attorney, Agent, or Firm* — Andrus Intellectual Property Law, LLP

(57) ABSTRACT

A marine drive has a supporting frame, an electric motor configured to power a propulsor for generating a thrust force in water, and an electrical power unit for the electric motor which is coupled to the supporting frame. Operation of the electrical power unit generates heat that is transferred to the supporting frame. A cowling encloses the electrical power unit and covers a first portion of the supporting frame. A different, second portion of the supporting frame is exposed to atmosphere outside the cowling. The supporting frame and cowling are configured so that the second portion of the supporting frame provides a heat exchanger that transfers the heat from the electrical power unit to the atmosphere.

20 Claims, 7 Drawing Sheets

MARINE DRIVES AND ARRANGEMENTS FOR COOLING ELECTRICAL COMPONENTS OF MARINE DRIVES

CROSS REFERENCE TO RELATED APPLICATION

This application claims benefit of priority to U.S. Provisional Application No. 63/445,916, filed Feb. 15, 2023, which is hereby incorporated by reference in entirety.

FIELD

The present disclosure relates to marine drives for propelling a marine vessel in water, and to arrangements for cooling electrical components of marine drives such as electrically powered marine drives.

BACKGROUND

The following U.S. patent publications are incorporated herein by reference in entirety:

U.S. Pat. Pub. No. 2023/0234688 discloses a marine drive for propelling a marine vessel. The marine drive has a propulsor configured to generate a thrust force in a body of water, an electric motor which powers the propulsor, a battery having a battery port for outputting battery power, a supporting frame which supports the marine drive relative to marine vessel, the supporting frame having a frame interior which retains the batter, and a cowling on the supporting frame. The cowling has a first cowl portion and a second cowl portion which is movable relative to the first cowl portion into a closed position enclosing the supporting frame and the battery in a cowling interior and alternately into an open position providing access to the cowling interior enabling insertion and removal of the battery.

U.S. Pat. Pub. No. 2023/0257094 discloses a marine drive for propelling a marine vessel. The marine drive has a propulsor configured to generate a thrust force in a body of water; a battery that powers the propulsor; and a supporting frame which supports the marine drive relative to marine vessel. The supporting frame has a monolithic body defining a frame interior, and further has a support leg extending downwardly from the monolithic body and a steering arm extending forwardly from monolithic body. A cowling is fixed to the supporting frame via at least one hidden fastener that extends from the frame interior, through the supporting frame, and into engagement with the cowl body, wherein hidden fastener being accessible during installation.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In non-limiting embodiments disclosed herein, a marine drive comprises a supporting frame, an electric motor configured to power a propulsor for generating a thrust force in water, and an electrical power unit for the electric motor which is coupled to the supporting frame, optionally the electrical power unit comprising a power storage device and/or a power entry module configured to control power supplied to the electric motor from the power storage device. Operation of the electrical power unit generates heat that is transferred to the supporting frame. A cowling encloses the electrical power unit and covers only a first portion of the supporting frame. A different, second portion of the supporting frame is exposed to atmosphere outside the cowling. The supporting frame and cowling are thus configured so that the second portion of the supporting frame functions as a heat exchanger which efficiently transfers the heat from the electrical power unit to the atmosphere.

In independent examples disclosed herein, in particular those examples configured as an outboard motor, the supporting frame may comprise a body, a support leg configured to support a propulsor housing for the propulsor, and a steering arm for steering of the marine drive. The electrical power unit may be coupled to the body and the body may comprise the first portion and the second portion. In independent examples, the supporting frame may be a monolithic component having a body defining the first portion and the second portion, wherein the body extends around a perimeter of the electrical power unit. The body may comprise a top wall, a bottom wall, a front wall, and a rear wall. The second portion of the supporting frame may be located along the rear wall. The supporting frame may comprise a spine located along the rear of the marine drive, for example along the noted rear wall. The spine may extend along a majority of the cowling along the rear of the marine drive.

In non-limiting examples, the cowling may comprise opposing side cowl panels which are disposed on opposite sides of the body and opposite sides of the spine. The opposing side cowl panels may overlap the supporting frame along the spine to reduce water intrusion to the cowling. The electrical power unit may be located adjacent to an interior surface of the second portion of the supporting frame.

In non-limiting examples, the marine drive may comprise at least one rib on an opposite, exterior surface of the second portion of the supporting frame, the rib being configured to promote heat transfer. The rib may be one of a plurality of ribs on the exterior surface of the second portion of the supporting frame, each rib in the plurality of ribs being configured to promote heat transfer.

BRIEF DESCRIPTION OF THE DRAWINGS

The present disclosure includes the following Figures.

DETAILED DESCRIPTION

Figure 1:
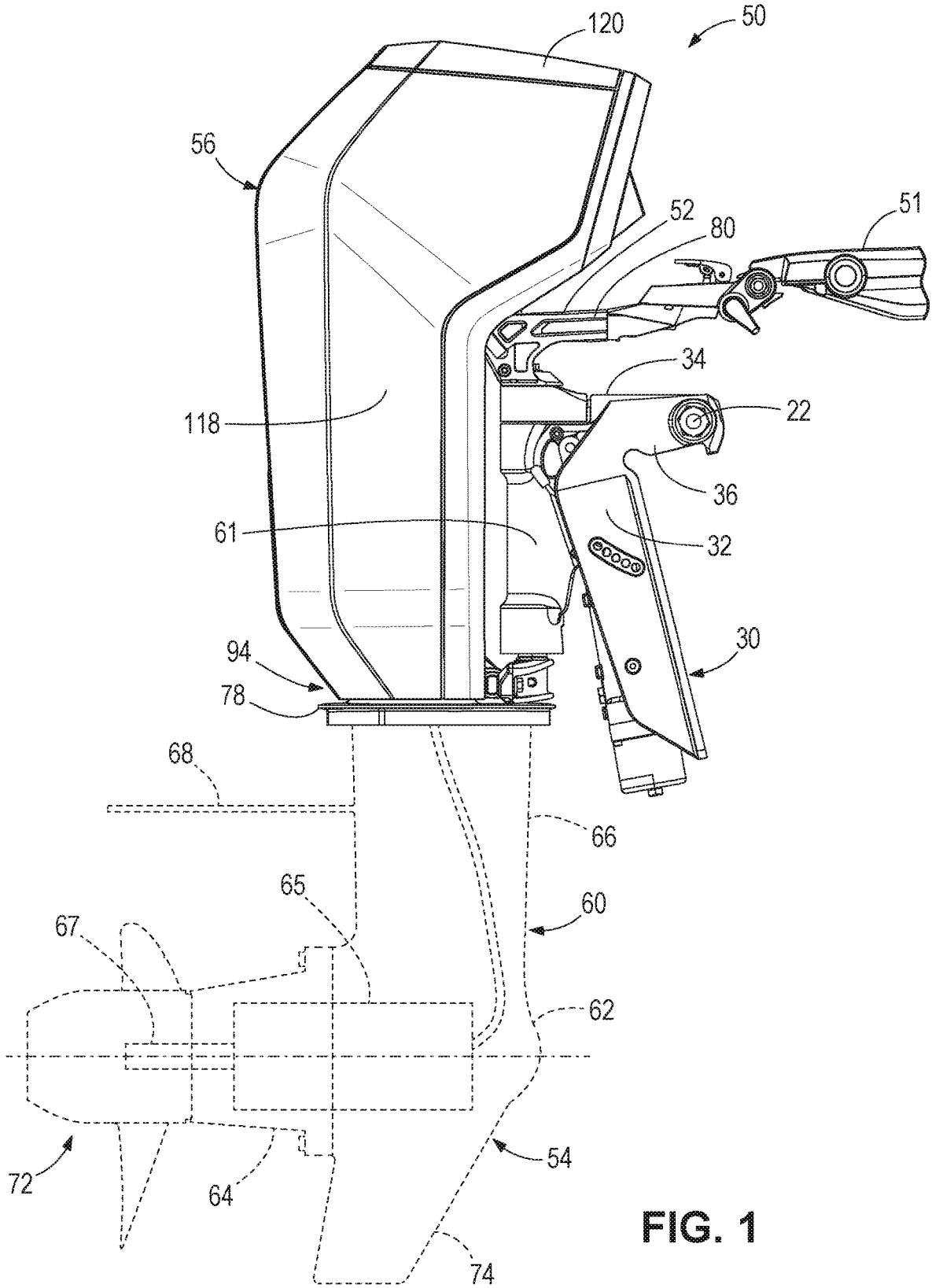
FIG. 1 is a starboard side view of a non-limiting embodiment of a marine drive according to the present disclosure.
Figure 2:
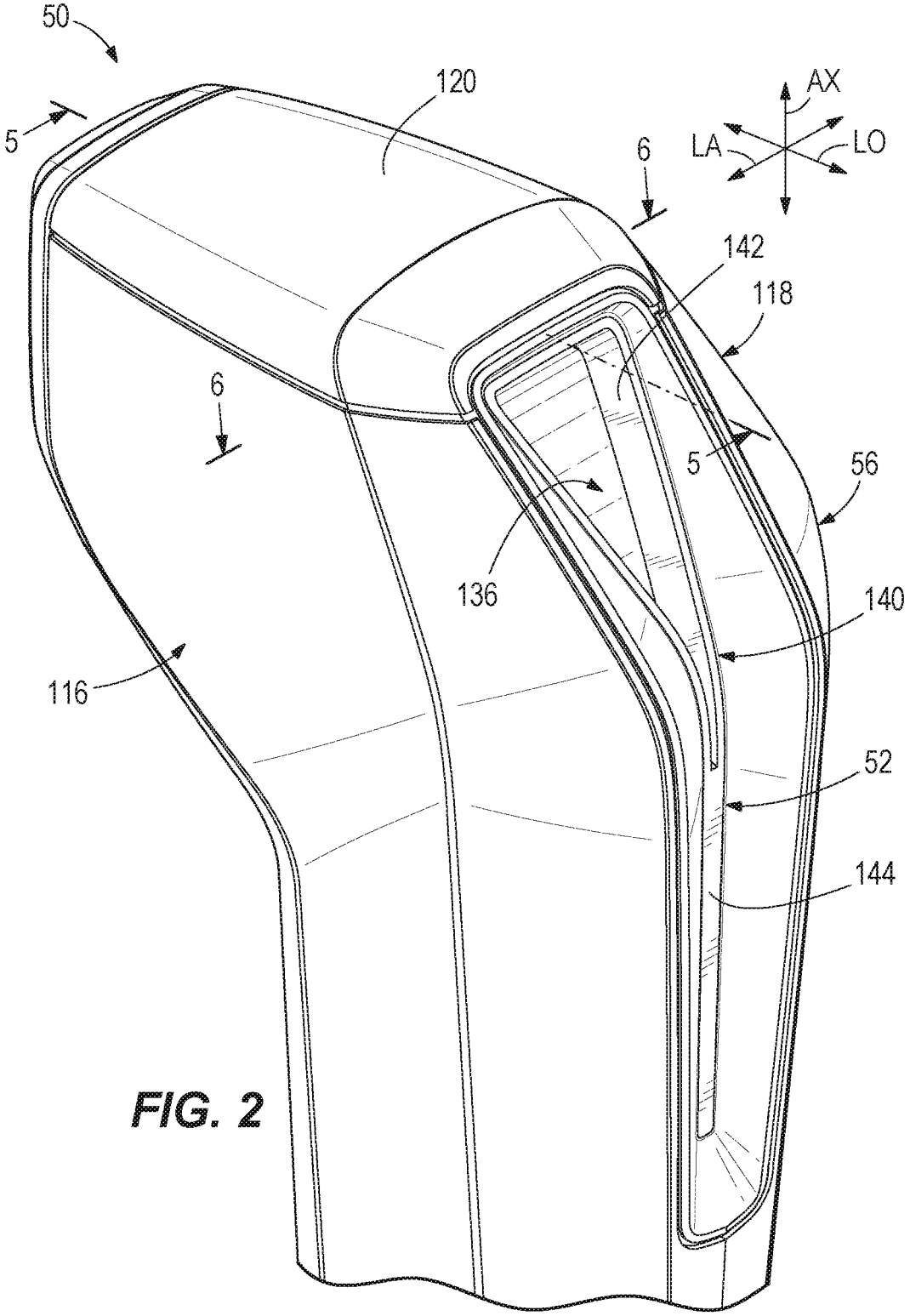
FIG. 2 is a rear perspective view of the marine drive.

FIGS. 1 and 2 depict a marine drive 50 for propelling a marine vessel (not shown) in a body of water. In the illustrated embodiment, the marine drive 50 is an outboard motor, however many of the concepts disclosed herein are also applicable to other types of marine drives, including for example stern drives, inboard drives, inboard/outboard drives, trolling motors, and/or the like. The marine drive 50 extends from top to bottom in an axial direction AX, from front to rear in a longitudinal direction LO which is perpendicular to the axial direction AX, and from side to opposite side in a lateral direction LA which is perpendicular to the axial direction AX and perpendicular to the longitudinal direction LO. A transom bracket assembly 30 supports the marine drive 50 on the transom of the marine vessel. The marine drive 50 is trimmable up and down relative to the marine vessel via the transom bracket assembly 30.

Figure 3:
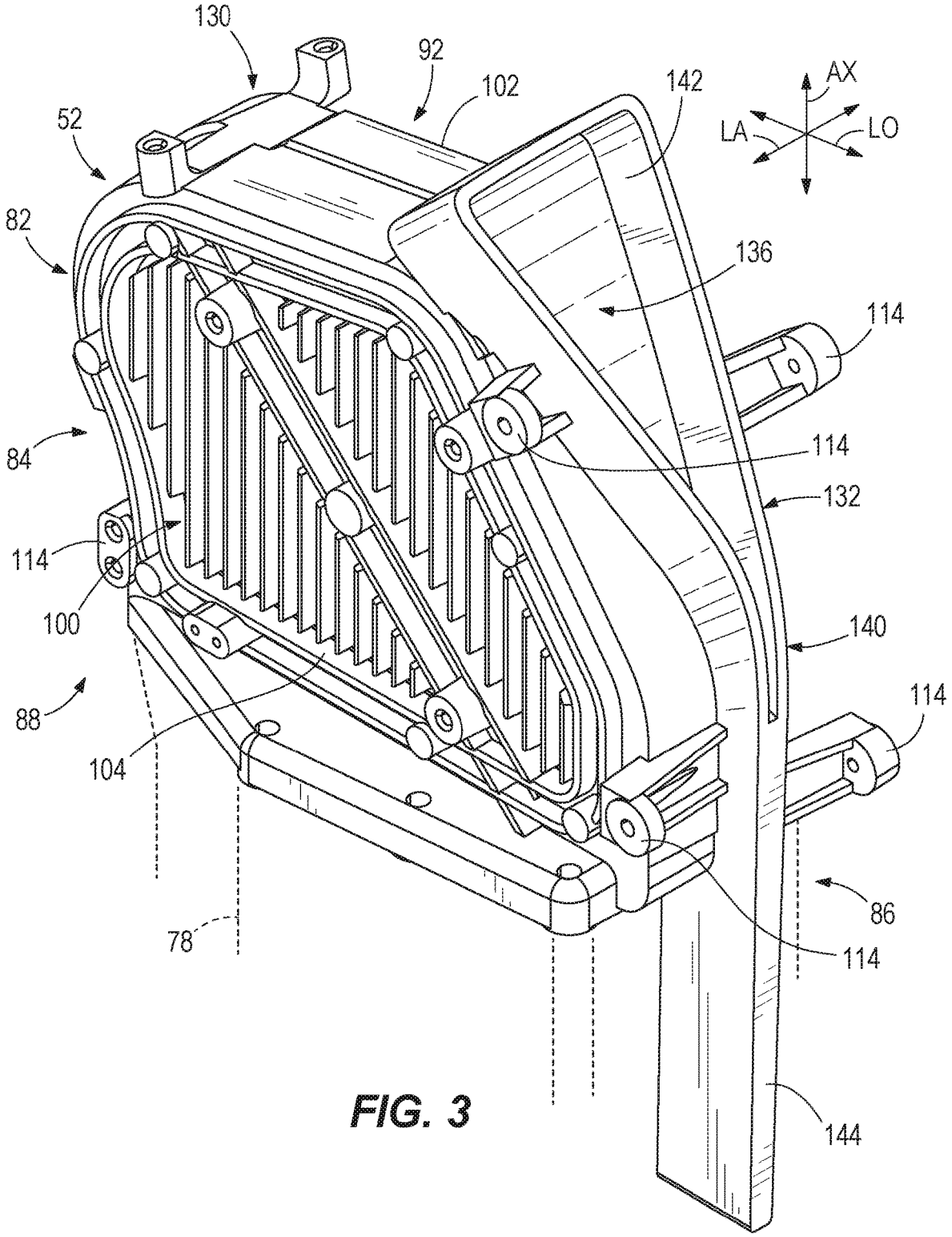
FIG. 3 is a rear perspective view of a supporting frame and an electrical power unit of the marine drive.

Referring to FIGS. 1-3, the marine drive 50 has a supporting frame 52 for rigidly supporting various components of the marine drive 50 and a propulsor housing 54 suspended from the supporting frame 52. The supporting frame 52 is made of metal, such as aluminum, and/or any other material that conducts heat. A cowling 56 is supported on and surrounds a portion of the supporting frame 52. As described herein below, the cowling 56 is made up of a plurality of cowling panels which together define a cowling interior 58 (FIG. 5), in which a portion of the supporting frame 52 and various components of the marine drive 50 are enclosed. As further explained herein below, the supporting frame 52 and cowling 56 are advantageously configured to efficiently promote transfer of heat from the electrical components enclosed in the cowling interior 58 to the surrounding atmosphere, thus cooling the electrical components.

The marine drive 50 has an extension leg 60 which is coupled to the supporting frame 52 and extends downwardly to the propulsor housing 54. The propulsor housing 54 has a front housing portion 62 and a rear housing portion 64 which together define a watertight cavity for containing an electric motor 65 and related componentry. The front housing portion 62 has a nosecone with a smooth outer surface which transitions upwardly to a stem 66 and downwardly to a skeg 74. An optional anti-ventilation plate 68 positioned above the stem 66 extends rearwardly from the extension leg 60. A conventional propulsor 72, which could be any device for generating thrust forces in water such as a propeller, impeller and/or the like, and which in the illustrated example is a propeller, is mounted on the outer end of a propulsor shaft 67 extending from the propulsor housing 54 so that rotation of the propulsor shaft 67 by the electric motor 65 causes rotation of the propulsor 72, which in turn generates a thrust force for propelling the marine vessel in water. The various components described above are exemplary and could vary from what is shown.

With continued reference to FIG. 1, the marine drive 50 is coupled to the transom of the marine vessel by the transom bracket assembly 30 which in the illustrated example includes a transom bracket 32 configured to be fixed to the transom and a swivel bracket 34 pivotably coupled to the transom bracket 32. The type and configuration of the transom bracket assembly 30 can widely vary. In the illustrated embodiment, the transom bracket 32 has a pair of C-shaped arms 36 which fit over and are clamped the top of the transom. In some embodiments, the transom bracket 32 is additionally or alternatively fixed to the transom by at least one fastener (not shown). The swivel bracket 34 is pivotable with respect to the C-shaped arms 36 about a pivot shaft embodiment laterally extends through the forward upper ends of the C-shaped arms 36, thereby defining a trim axis 22. Pivoting of the swivel bracket 34 about the pivot shaft trims the marine drive 50 relative to the marine vessel, for example out of and/or back into the body of water in which the marine vessel is operating. In other embodiments, the marine drive 50 can include an electric and/or hydraulic trim actuator, as is well known in the art.

The marine drive 50 is supported on the swivel bracket 34 by a steering arm 80, which extends from the body 82 of the supporting frame 52 of the marine drive 50, generally along the midsection of the marine drive 50. A swivel tube assembly 61 extends transversely from the steering arm 80 and is removably received in a swivel cylinder (not shown) of the swivel bracket 34. The marine drive 50 can be steered left or right relative to the marine vessel by rotating about the steering axis 20, which is defined by the swivel tube and swivel cylinder, via a manually operable tiller 51 and/or any other known mechanical, electrical and/or hydraulic apparatus for steering a marine drive with respect to a marine vessel.

Figure 4:
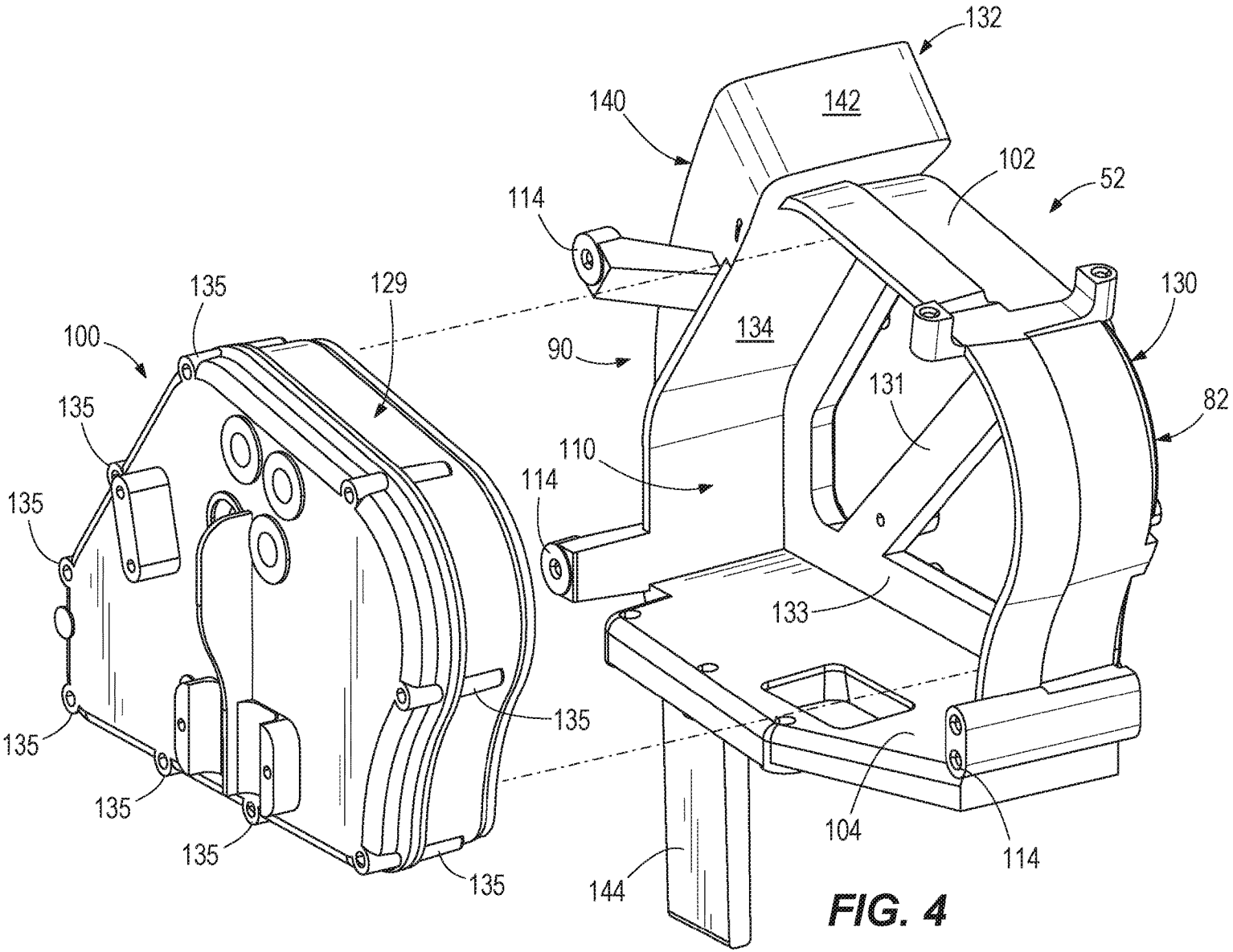
FIG. 4 is an exploded view of the supporting frame and power unit.
Figure 5:
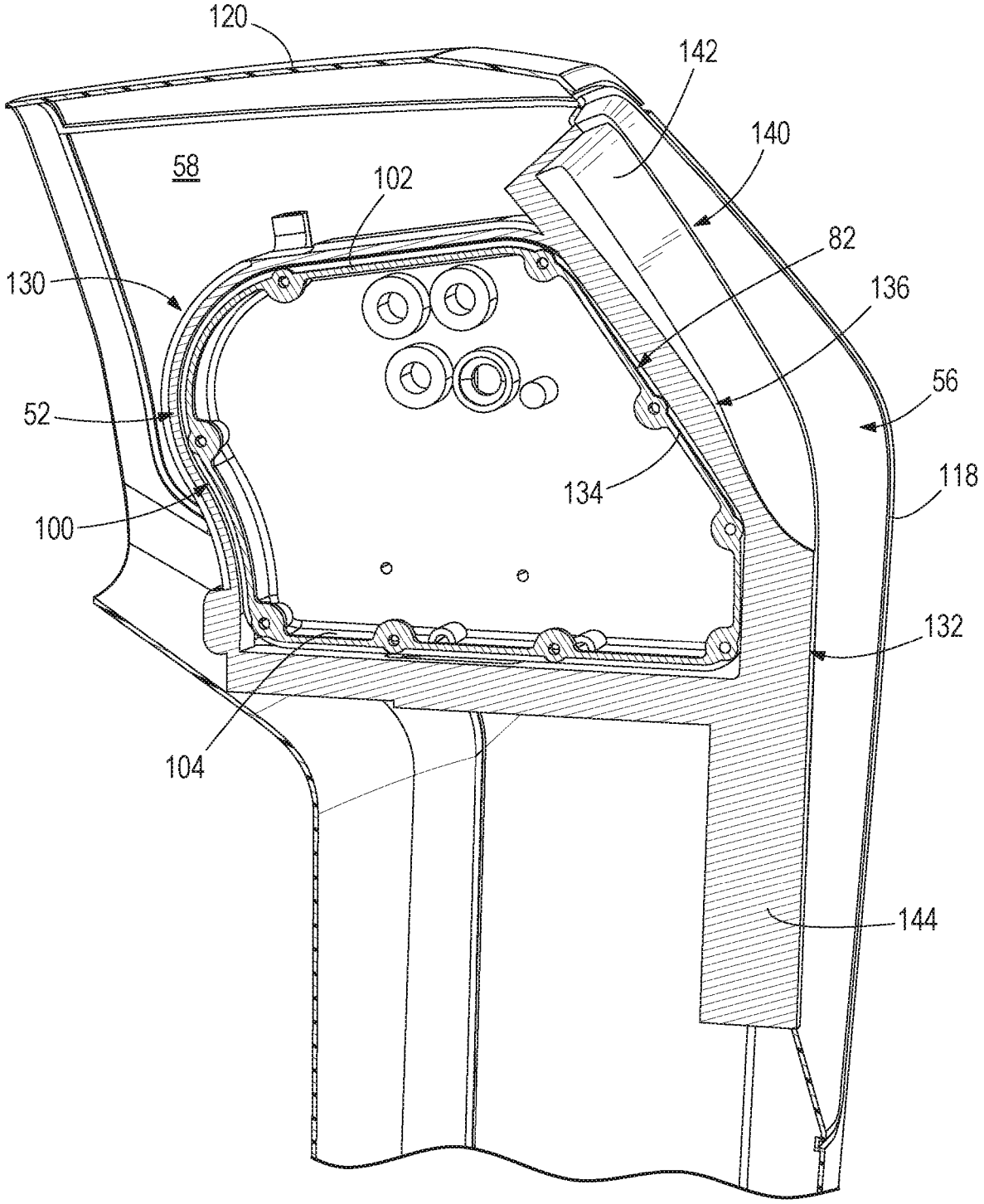
FIG. 5 is a view of Section 5-5, taken in FIG. 1.

Referring to FIGS. 3-5, the supporting frame 52 extends from a front side 84 to a rear side 86 in the longitudinal direction LO, from a port side 88 to a starboard side 90 in the lateral direction LA, and from a top end 92 to a bottom end 94 (FIG. 1) in the axial direction AX. The supporting frame 52 includes a body 82 and a support leg 78 (shown schematically in FIG. 3) which extends downwardly from the body 82 and is configured to support the extension leg 60 and the propulsor housing 54, as described above.

In the illustrated embodiments, the supporting frame 52 is a monolithic structure wherein the body 82, the steering arm 80, and the support leg 78 are a single, unitary component primarily made of a heat conductive material such as aluminum. Some embodiments, however, may include a multi-part supporting frame wherein at least one of the support leg 78, steering arm 80, and/or body 82 is/are configured as separate components wherein at least portions of the body 82 are made of the heat conductive material.

As previously mentioned, the supporting frame 52 is a rigid structure which is configured to support a plurality of electrical components for operating the marine drive 50. The type of electrical component may vary and may include any conventional electric component or "electrical power unit" that is for powering and/or controlling power supplied to the noted electric motor 65 and that generates heat during use. One such component is shown and described herein below including a power entry module (PEM) 100. The PEM 100 is a conventional electrical device including an inverter and/or various other associated electrical connectors and components, etc., for regulating/controlling current and voltage supplied to the marine drive 50 to power the electric motor 65 and/or other components of the marine drive 50. This type of electrical power unit is available for purchase from Mercury Marine as part of the Avator® 7.5e electric outboard motor. In that example, a power supply such as one or more power storage device(s), including for example batteries, are located in the marine vessel associated with the marine drive and are electrically coupled to and supply power to the PEM 100, via for example rigging connectors extending from the marine vessel to the marine drive 50. The PEM 100 is operationally positioned in an electrical circuit between the noted power storage device(s) and the motor 65. Among other things, the PEM 100 may contain a DC link capacitor to provide the above-described functionality, including filtering. The DC link capacitor may be a single capacitive element, or a capacitor bank sized appropriately depending upon the capacity of the noted power storage device(s). The PEM 100 may also include one or more current limiting circuits configured to control current flow from the noted power storage device(s) to the noted link capacitor during a pre-charge process.

However, it should be understood that according to the present disclosure the type and configuration of the "electrical power unit" may vary and in other examples may also or alternately comprise one or more power storage device(s), such as rechargeable (e.g., lithium) batteries that directly provide battery power to the electric motor 65.

As recognized by the present inventor, operation of the electrical power unit, including but not limited to the illustrated example the PEM 100, generates heat. If the amount of heat generated by the electrical power unit becomes too great, performance and operational life of the electrical power unit and various other components within the cowling interior 58 may be negatively impacted. This is a problem which has been realized by the present inventor and the present disclosure provides his novel solution for overcoming this problem which does not necessarily require a supply of cooling fluid to the interior of the cowling interior 58 and/or a provision of forced air to the cowling interior 58, which require additional space within the marine drive 50 as well as additional design features adding cost.

Referring now to FIGS. 3-5, the PEM 100 is coupled to the body 82 of the supporting frame 52 and enclosed within the cowl interior 58. The body 82 of the supporting frame 52 has a top wall 102, a bottom wall 104, a front wall 106 and a rear wall 108 which together surround and define a cavity 110 in which the PEM 100 is mounted, for example by fasteners, for example extending into one or more crossbars 131 extending along one lateral side of the supporting frame 52. As shown, the body 82 extends around and closely follows an outer perimeter 129 of the PEM 100 in both the axial AX and longitudinal LO directions. The body 82 has a cross-bar 131 and perimeter apron 133 that follows the internal perimeter surfaces of the body partially close or block off one lateral side of the supporting frame 52 for retaining the PEM 100, whereas the opposite lateral side remains open for receiving the PEM 100. In this manner, the PEM 100 is snugly nested in a cavity 110 formed by the supporting frame 52. The supporting frame 52 closely follows or abuts all perimeter sides of the PEM 100 in the axial AX and longitudinal LO directions. In the illustrated example, various rounded abutment surfaces 135 on the exterior of the PEM 110 abut the interior perimeter surfaces of the body 82 of the supporting frame 52. The one or more crossbars 131 and a perimeter apron 133 laterally support the PEM 100. Thus, when the PEM 100 is mounted in the cavity 110 it is located closely adjacent to and/or abut the interior surfaces of the perimeter of the body 82, all along the axial AX and longitudinal LO interior sides of the cavity 110, as shown, and laterally via the one or more cross-bars 131 and the perimeter apron 133, as shown.

Referring to FIGS. 3-6, the cowling 56 includes opposing side cowl panels 116, 118 which are fastened to opposite sides of the supporting frame 52 via for example fasteners extending into mounting bosses 114 on the body 82, along the perimeter of the cavity 110. The cowling 56 also includes a service lid 120 which is pivotally coupled to the top of the supporting frame 52 by a hinge (not shown). The service lid 120 is pivotable into and between a closed position (shown in the figures) enclosing the PEM 100 and a portion of the supporting frame 52 in the cowling interior 58, and an open position providing access thereto for servicing and/or insertion and removal of components, and/or the like. When the service lid 120 is in the closed position, the PEM 100 and a portion of the supporting frame 52 are fully enclosed in cowling interior 58 and thus heat generated by the PEM 100 and other electronic components heats the cowling interior 58.

Figure 6:
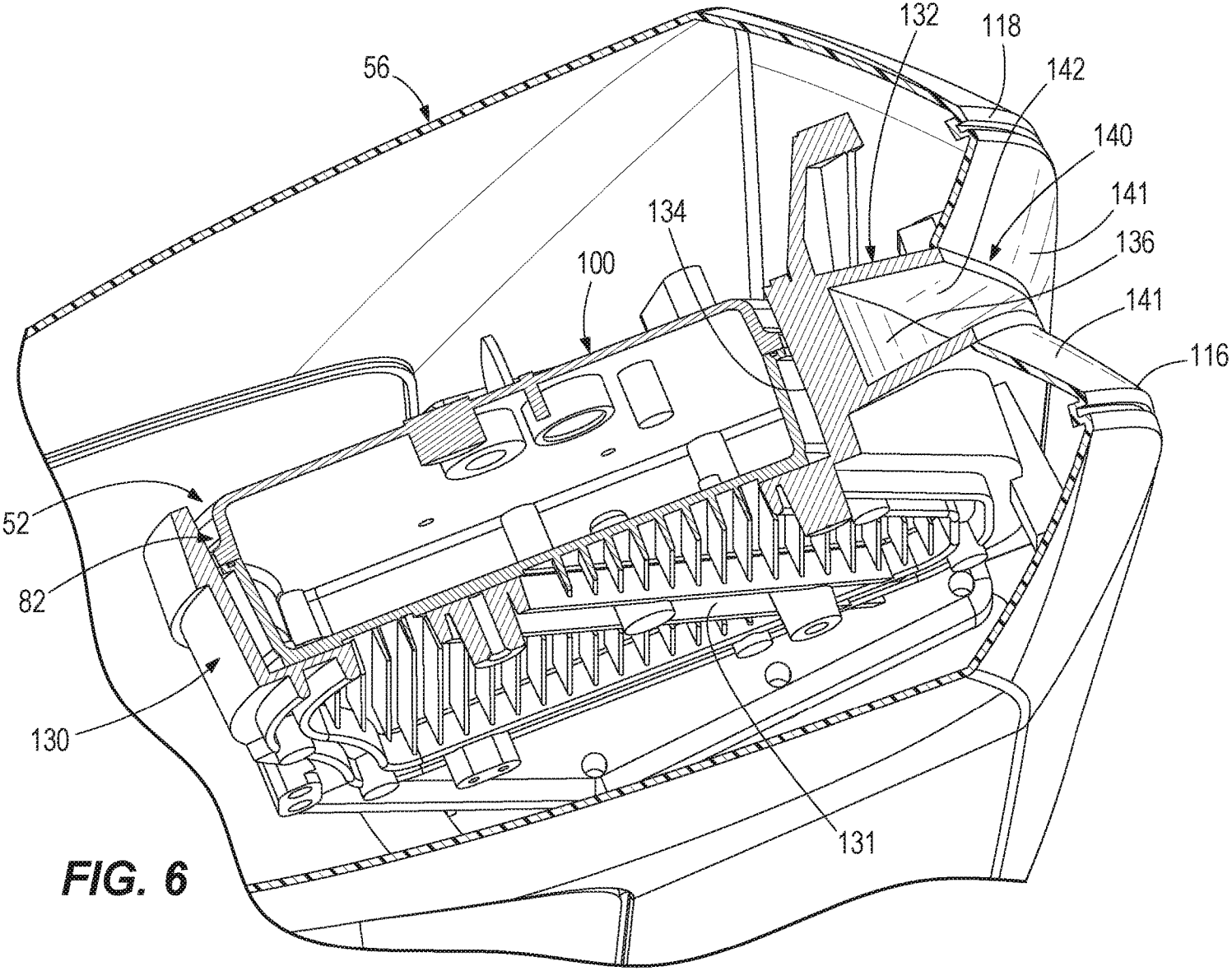
FIG. 6 is a view of Section 6-6, taken in FIG. 1.

As best shown in FIG. 5, the body 82 of the supporting frame 52 has a first portion 130 which is located in the cowling 56. The first portion 130 is fully enclosed in the cowling interior 58 at least when the service lid 120 is in the closed position. The supporting frame 52 also has a second portion 132 having an interior surface 134 (see FIG. 4) which is located and remains entirely within the cowling 56. The interior surface 134 extends along and is located adjacent to the PEM 100 and is fully enclosed in the cowling interior 58 when the service lid 120 is in the closed position. The second portion 132 also has an exterior surface 136, which is directly longitudinally opposite the interior surface 134, and which remains exposed to the atmosphere outside the cowling 56 regardless of whether the service lid 120 is in the open or closed position. The exterior surface 136 extends generally in the axial direction AX along the rear of the marine drive 50. The exterior surface 136 generally defines a spine 140 running axially and longitudinally upwardly along the rear of the marine drive 50. As best seen in FIG. 5, the PEM 100 is disposed in the cavity 110 and is located immediately adjacent the interior surface 134 and directly on the opposite side of the exterior surface 136. The spine 140 axially extends along the exterior surface 136. The spine 140 remains exposed to the atmosphere during all operational phases of the marine drive 50, i.e., regardless of whether the service lid 120 is open or closed. The shape and configuration of the spine 140 may vary from what is shown. In the illustrated example, the spine 140 has sidewalls 142 protruding outwardly from the exterior surface 136, together defining a generally triangular shape which transitions to an end wall 144 that axially extend downwardly along the rear of the marine drive 50. The spine 140 axially extends along the majority of the rear of the marine drive 50. Referring to FIG. 6, the opposing side cowl panels each have edges 141 that laterally overlap the supporting frame 52 along the spine 140 at the rear of the marine drive 50 and thus reduce water intrusion to the cowling interior 58. Optionally a seal may be located along the edges of the opposing side cowl panels to further reduce water intrusion.

Figure 7:
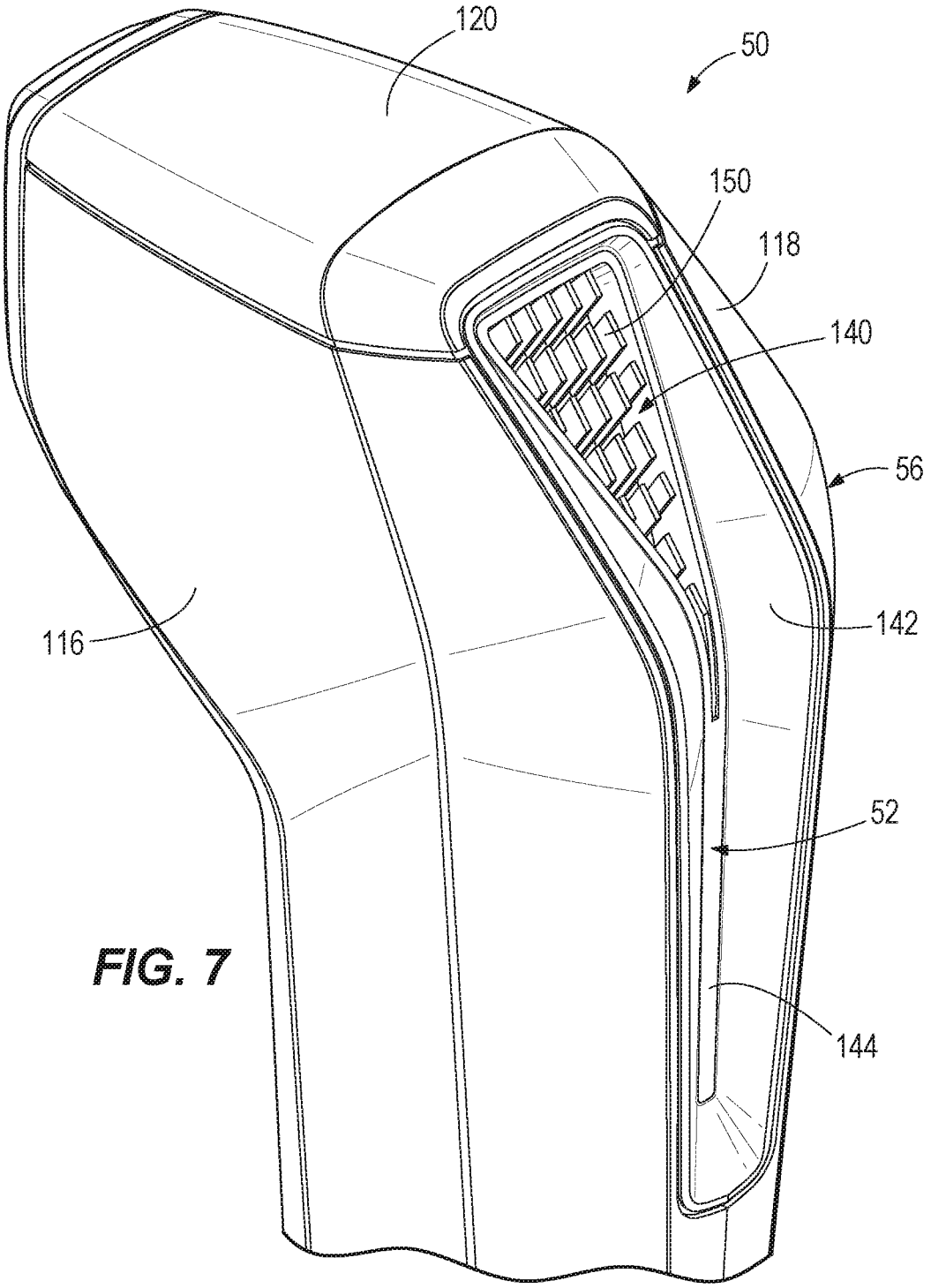
FIG. 7 is rear perspective view of an alternate embodiment of a marine drive according to the present disclosure.

FIG. 7 depicts an alternate embodiment of the marine drive 50 having a plurality of ribs 150 protruding rearwardly from the exterior surface 136 within the triangular shape of the spine 140. The ribs 150 advantageously promote heat transfer between the supporting frame 52 and atmosphere. The number, shape, size and location of the ribs 150 may vary from what is shown. In the illustrated example, the ribs 150 are generally rectangular, having longer edges extending generally longitudinally outwardly from the exterior surface 136 and relatively shorter edges extending generally axially relative to the longer edges.

It will thus be understood that the present disclosure provides embodiments of a marine drive 50 having a supporting frame 52 and a cowling 56 that are specially configured so that a portion of the supporting frame 52 is a heat conductive member or heat exchanger which remains exposed to atmosphere and thus provides heat exchange, efficiently transferring the heat from the electrical power unit (e.g., a power entry module and/or a storage device such as a battery, all as described herein above) and/or any other electrical components within the cowling interior and in proximity to the supporting frame 52 to the atmosphere for cooling said components.

This written description uses embodiments to disclose the invention in a manner that enables a person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other embodiments embodiment occur to those skilled in the art. Such other embodiments are intended to be within the scope of the claims if they have features or structural elements embodiment do not differ from the literal language of the claims, or if they include equivalent features or structural elements with insubstantial differences from the literal languages of the claims.

What is claimed is:

1. A marine drive comprising:

an electric motor configured to power a propulsor for generating a thrust force in water;

a supporting frame configured to support the electric motor and the propulsor relative to a marine vessel;

an electrical power unit for the electric motor, the electrical power unit being coupled to the supporting frame, wherein operation of the electrical power unit generates heat that is transferred to the supporting frame; and a cowling that encloses the electrical power unit and covers a first portion of the supporting frame, wherein a second portion of the supporting frame that is different than the first portion of the supporting frame is exposed to atmosphere outside the cowling, and further wherein the supporting frame and cowling are configured so that the second portion of the supporting frame functions as a heat exchanger that transfers the heat from the electrical power unit to atmosphere.

2. The marine drive according to claim 1, wherein the marine drive is an outboard motor.

3. The marine drive according to claim 1, wherein the supporting frame comprises a body, a support leg configured to support a propulsor housing for the propulsor, and a steering arm for steering of the marine drive relative to the marine vessel.

4. The marine drive according to claim 3, wherein the electrical power unit is coupled to the body.

5. The marine drive according to claim 4, wherein the body comprises the first portion and the second portion.

6. The marine drive according to claim 1, wherein the electrical power unit comprises an inverter.

7. The marine drive according to claim 1, wherein the supporting frame is a monolithic component.

8. The marine drive according to claim 1, wherein the supporting frame comprises a body defining the first portion and the second portion.

9. The marine drive according to claim 8, wherein the body extends around a perimeter of the electrical power unit.

10. The marine drive according to claim 8, wherein the body comprises a top wall, a bottom wall, a front wall, and a rear wall, and further wherein the second portion is located along the rear wall.

11. The marine drive according to claim 10, wherein the supporting frame comprises a spine located along the rear wall.

12. The marine drive according to claim 11, wherein the spine extends along a majority of the cowling.

13. The marine drive according to claim 11, wherein the cowling comprises opposing side cowl panels that are disposed on opposite sides of the spine.

14. The marine drive according to claim 13, wherein the opposing side cowl panels overlap the supporting frame along the spine to reduce water intrusion to the cowling.

15. The marine drive according to claim 1, wherein the electrical power unit is adjacent to an interior surface of the second portion of the supporting frame.

16. The marine drive according to claim 15, further comprising a rib on an opposite, exterior surface of the second portion of the supporting frame, the rib being configured to promote heat transfer.

17. The marine drive according to claim 16, wherein the rib is one of a plurality of ribs on the exterior surface of the second portion of the supporting frame, each rib in the plurality of ribs being configured to promote heat transfer.

18. The marine drive according to claim 1, wherein the electrical power unit comprises a power entry module configured to control a frequency of power supplied to the electric motor.

19. The marine drive according to claim 1, wherein the cowling comprises a top cowl and wherein the supporting frame comprises a spine located along a rear of the top cowl.

20. The marine drive according to claim 19, wherein the spine protrudes from a rear of the supporting frame.

* * * * *